United States Patent [19]

Schrecongost

[11] 4,141,270

[45] Feb. 27, 1979

[54] MODULATED KEYER SUPPLY SAMPLING CIRCUIT

[75] Inventor: Ray B. Schrecongost, Park Ridge, Ill.

[73] Assignee: Hammond Corporation, Chicago, Ill.

[21] Appl. No.: 809,503

[22] Filed: Jun. 23, 1977

[51] Int. Cl.[2] ..... G10H 1/02

[52] U.S. Cl. ..... 84/1.24; 84/1.19; 84/1.03; 84/DIG. 12

[58] Field of Search ..... 84/1.03, 1.11, 1.19, 84/1.24, DIG. 12

[56] References Cited

U.S. PATENT DOCUMENTS

| | | | |
|---|---|---|---|
| 3,764,721 | 10/1973 | Maynard | 84/1.11 |
| 3,803,338 | 4/1974 | Adachi | 84/1.19 |
| 3,922,943 | 12/1975 | Niinomi | 84/1.19 |

*Primary Examiner*—Robert K. Schaefer
*Assistant Examiner*—Leonard W. Pojunas, Jr.
*Attorney, Agent, or Firm*—John J. McArdle, Jr.

[57] ABSTRACT

In a chopper keyer electronic organ system, a sampling network samples the drawbar inputs to the chopper keyers in order to provide a separate channel of percussion. The drawbar lines for one or more of the footages are sampled and the sample signal is amplified and shaped to provide touch envelope percussion in addition to the sounding of the chopper keyer outputs. Alternatively, the chopper keyer outputs may be disabled and separate voicing such as for piano, harpsichord or steady tones provided via the drawbar sampling circuitry.

4 Claims, 2 Drawing Figures

MODULATED KEYER SUPPLY SAMPLING CIRCUIT

BACKGROUND OF THE INVENTION

The field of the invention is electronic musical instruments.

The essential elements of a MOSFET chopper keyer system are shown in U.S. Pat. No. 3,636,231, assigned to the assignee of the present invention. As shown in that patent in an exemplary embodiment, each of nine (9) different footages or harmonics at desired amplitude settings, determined by adjustment of drawbar supply voltages, are keyed by separate MOSFET keyer circuits for each of sixty-one (61) keys. Each keyer circuit also has a modulated signal source input such as a square wave and a playing key input which couples the chopped drawbar input to the keyer circuit output when the playing key is depressed. The outputs of the keyer circuits are grouped by similar frequencies usually within one octave and collectively coupled to sine wave, or band pass, filters and eventually to an audio output system and speaker.

In such MOSFET chopper keyer systems percussion for played notes has been provided by pulsing the drawbar supply voltage on suddenly for a particular harmonic and decaying at a less rapid rate, with the signal output coming from the frequency grouped terminals. This causes the percussion which is added to be animated if the sine wave outputs are animated, which can be an undesirable effect. Alternatively, an entirely separate set of keyer circuits may be utilized for one or more footages, for example, in order to produce a separate channel of percussion which would not be animated. This approach entails the additional cost for the separate keyer circuitry.

SUMMARY OF THE INVENTION

Sampling the drawbar inputs to the keyer circuits produces a modulated waveform which may be used for percussion or other separate channel effects without the need for separate keyer circuits and free of any output animation. The drawbar supply inputs are grouped according to particular harmonics of played notes with each group of supply inputs being coupled from a common supply source while the keyer circuit outputs are not so grouped. Waveshaping of the sampled waveform may be performed in order to produce a separate channel output such as for piano voicing.

DESCRIPTION OF THE PREFERRED EMBODIMENTS

Figure 1:
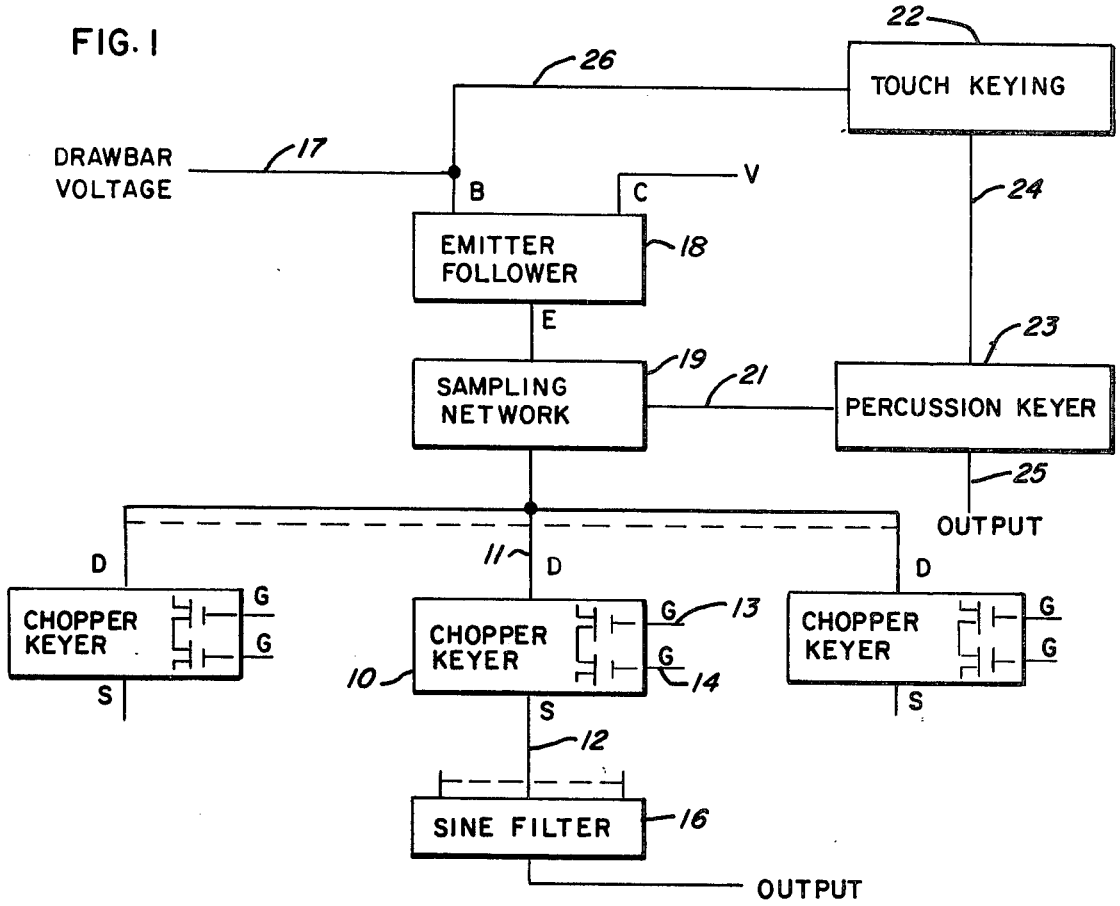
FIG. 1 is a diagrammatic showing of an embodiment of the present invention wherein the sampled signals are used for separate channel percussion.

Referring in particular to FIG. 1, there is shown a portion of a separate channel percussion system embodying the present invention. A chopper keyer circuit 10 comprising two FET's in series has a drain input 11, source output 12 first gate input 13 and second gate input 14. The essential configuration is two MOSFET devices connected in series in the fashion disclosed in the above-mentioned U.S. Pat. No. 3,636,231. The basic system shown there is essentially the same as that improved upon in the present disclosure. The output line 12 from the chopper keyer source is coupled to a sine filter 16 as are the source output lines of other chopper keyer circuits. A given sine filter 16 receives signal frequencies within an octave span.

Gate line 14 is coupled from a switch activated by a playing key on the keyboard of the electronic musical instrument. Gate line 13 is coupled from a square wave generator source. This modulating signal is always present on line 13. The two gate connections could, if desired, be reversed. Drain line 11 normally has impressed upon it a DC voltage dependent upon the drawbar setting for a given harmonic. Thus there are, in the exemplary embodiment, nine drawbar setting lines for the sixty-one different keys resulting in five hundred forty-nine chopper keyer circuits such as 10. Of those chopper keyer circuits, the circuit 10 of FIG. 1 and eleven others would be coupled on lines such as line 12 in an octave group to one sine filter 16.

Line 17 is coupled from the drawbar voltage source for one harmonic, or footage. Eight other drawbar voltages are keyed through chopper keyers for each playing key depressed, but the present description is for a percussion envelope generated from one drawbar only. Additional drawbars may be similarly utilized by sampling other drawbar supplies in the fashion to be described below for line 17. The drawbar DC voltage on line 17 is normally coupled into the collector of an emitter follower circuit 17 and then to the drawbar inputs of sixty-one chopper keyers 10.

As shown in FIG. 1, a sampling circuit 19 is inserted between emitter follower 18 and chopper keyer 10 to sample the chopped current flowing into drain line 11. When chopper keyer 10 is keyed on through line 14, the drawbar input on line 11 is chopped at the frequency of the signal on line 13, and the output signal is coupled on line 12 to the appropriate sine filter circuit 16.

Thus, if line 17 were coupled from the 4', or second harmonic, drawbar and key line 14 were coupled from the middle C key, the second harmonic frequency of middle C would be sampled by sampling network 19 and placed onto line 21 at the output of the sampling network. The second harmonic frequency of any of the sixty-one played notes will appear on line 21 from the same sample circuit output.

A touch keying waveform generator 22 couples a sharply rising and slowly decreasing keying waveform with a duration of, for example, one to two seconds on line 24 to a percussion keying circuit 23, which also receives the sampled output on line 21. The resulting percussion envelope on line 25 is coupled to an output such as a separate audio channel. The touch keying waveform generating system 22, which, for example, responds to the activation of a "first played" key by sensing DC current from a keying bus, thus initiates a percussion sound for the first key depressed of a group of keys depressed. If desired, a legato keying waveform generator which operates on successive activation of playing keys could be used in place of the touch keying waveform generator 22.

In addition to the keying wave output line 24 which goes to the percussion keyer 23, another touch keying waveform output line 26 is superimposed on the drawbar voltage line 17. If the drawbar voltage setting on line 17 were at zero, then the keying waveform voltage on line 26 would enable passage of sampled signals during the time of the keying waveform signal. Thus, even if the drawbar voltage were at zero on the 4' drawbar, percussion would still be produced. If the drawbar voltage on line 17 were increased, there would be less effect from the keying waveform generated on line 26. However, the duration of the signal on line 25 would be somewhat greater with the constant drawbar voltage from line 17 rather than the keying waveform voltage from line 26. The keying waveform on line 26 should be similar to the keying waveform on line 24.

Figure 2:
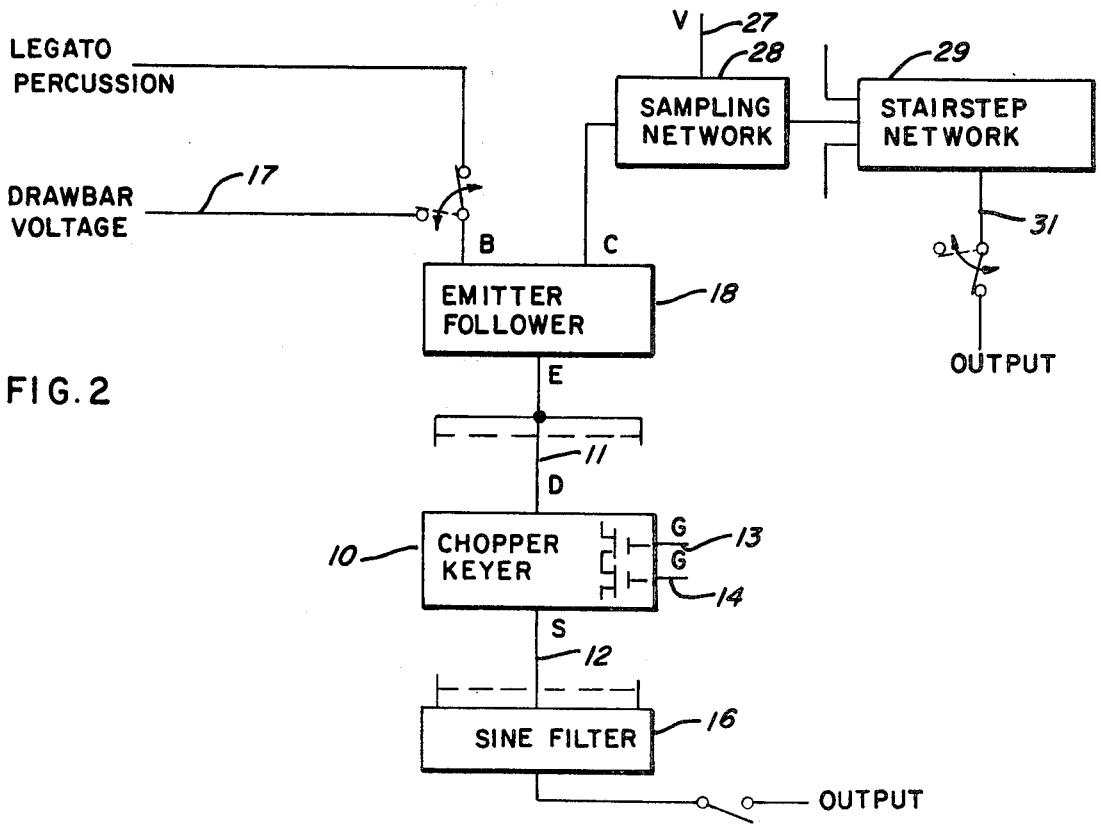
FIG. 2 is a diagrammatic showing of another embodiment of the invention wherein the sampling is utilized to accomplish separate piano voicing.

Referring now to FIG. 2, there is shown a piano voicing circuit utilizing a similar sampling technique. Chopper keyer 10, sine filter 16, emitter follower 18 and drawbar voltage source 17 are essentially the same as those shown in FIG. 1. In the scheme of FIG. 2, however, the supply voltage on line 27 is sampled in the collector line of the emitter follower 18 rather than in the emitter line.

In this embodiment, the sine filter outputs from chopper keyers 10 are disconnected and only the piano voicing is utilized when the circuit is in operation. The emitter follower 18 associated with each chopper keyer 10 has its base circuitry disconnected from the normal drawbar voltage output 17, and it is connected to a legato percussion keyer waveform generator, examples of which are well known.

During the period of keyer waveform generation, a signal is extracted from supply line 27 through sampling network 28 to the collector circuitry of emitter follower 18 and then through its emitter circuitry to the chopper keyer 10, etc. The outputs of the sine filters will now be coupled to speakers during this mode of operation. When the appropriate key, for example, middle C, is depressed, the keying signal on line 14 couples, for the period of the legato envelope, the chopped square waves or other modulating signal on line 13 through chopper keyer 10. This envelope-defined series of square waves is sampled by sampling network 28 and coupled to a stair-step generator, amplifier and filter network. In the exemplary embodiment, the other two inputs to the stair-step generator network 29 are from 8' and 16' drawbar samplers similar to sampling circuit 28. Standard stair-stepping and filtering techniques are utilized to produce piano voicing for a separate output. This output line 31 is switched off when electronic musical instrument tones such as those simulating a pipe organ are produced rather than piano voicing. Other similar special voices such as for harpsichord may be produced using appropriate networks similar to network 29.

If it is desired to produce steady state tones, normal drawbar voltages 17 would be applied to the emitter follower 18 so that, upon key activation, organ tones would result to be appropriately voiced. The animation separation is preserved.

What is claimed is:

1. In an electronic musical instrument keying system having several keyer circuits each including a supply input, an output, a modulated input and a keyed input, the supply inputs being grouped according to particular harmonics of played notes with each such group of supply inputs being coupled from a common source and the outputs not being so grouped, the improvement comprising:

(a) sampling means coupled to a said common source for sampling modulation of its associated supply inputs and having an output; and (b) waveshaping means coupled from the output of the sampling means for producing desired audio output waveforms.

2. The improvement of claim 1 in which the waveshaping means comprises keying waveform generator means for producing at an output a keying waveform responsive to the keying of a played note, said keying also providing a signal to the keyed input of a keyer circuit, and percussion keyer means coupled from the output of the keyer waveform generator means and the output of the sampling means for producing at an audio output the sampled modulation from the sampling means shaped by the keying waveform of the keying waveform generator means.

3. The improvement of claim 2 in which the keying waveform generator means has a second output coupled to said common source which superimposes a keying waveform upon the supply inputs.

4. The improvement of claim 1 which further comprises keying waveform generator means for shaping the sampled modulation of the sampling means within a keying waveform.

* * * * *